US007744999B2

(12) United States Patent
Zhu

(10) Patent No.: US 7,744,999 B2
(45) **Date of Patent: *Jun. 29, 2010**

(54) CRYSTALLIZED META-ARAMID BLENDS FOR IMPROVED FLASH FIRE AND ARC PROTECTION

(75) Inventor: Reiyao Zhu, Moseley, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 180 days.

This patent is subject to a terminal disclaimer.

(21) Appl. No.: 12/218,125

(22) Filed: Jul. 11, 2008

(65) Prior Publication Data

US 2010/0009186 A1 Jan. 14, 2010

(51) Int. Cl.
*B32B 27/34* (2006.01)

(52) U.S. Cl. ..... 428/395; 428/365; 2/458; 442/301; 442/302

(58) Field of Classification Search ..... 428/357, 428/365, 395; 2/248; 442/301, 302
See application file for complete search history.

(56) References Cited

U.S. PATENT DOCUMENTS

| | | | | |
|---|---|---|---|---|
| 3,193,602 | A | 7/1965 | Leonard et al | |
| 3,354,127 | A | 11/1967 | Hill, Jr. et al | |
| 3,673,143 | A | 6/1972 | Bair et al. | |
| 3,748,302 | A | 7/1973 | Jones et al. | |
| 3,803,453 | A | 4/1974 | Hull | |
| 3,819,587 | A | 6/1974 | Kwoleck | |
| 3,869,429 | A | 3/1975 | Blades | |
| 4,172,938 | A | 10/1979 | Mera et al. | |
| 4,612,150 | A | 9/1986 | De Howitt | |
| 4,668,234 | A | 5/1987 | Vance et al. | |
| 4,755,335 | A | 7/1988 | Ghorashi | |
| 4,883,496 | A | 11/1989 | Ghorashi | |
| 5,096,459 | A | 3/1992 | Ghorashi | |
| 5,208,105 | A | 5/1993 | Ichibori et al. | |
| 5,506,042 | A | 4/1996 | Ichibori et al. | |
| 6,743,498 | B2 * | 6/2004 | Fourmeux | 428/131 |
| 7,065,950 | B2 * | 6/2006 | Zhu et al. | 57/255 |
| 7,348,059 | B2 * | 3/2008 | Zhu et al. | 428/395 |
| 2001/0009186 | A1 * | 7/2001 | Perrella et al. | 164/472 |
| 2005/0025963 | A1 | 2/2005 | Zhu | |
| 2005/0287364 | A1 * | 12/2005 | Zhu et al. | 428/357 |
| 2006/0135014 | A1 * | 6/2006 | Murphy et al. | 442/304 |
| 2007/0094763 | A1 * | 5/2007 | Silver | 2/69 |
| 2007/0224405 | A1 * | 9/2007 | Bascom et al. | 428/221 |

* cited by examiner

*Primary Examiner*—N. Edwards

(57) ABSTRACT

A yarn, fabric, and garment suitable for use in arc and flame protection and having improved flash fire protection contains a majority, by weight, of meta-aramid fibers having a degree of crystallinity of at least 20%, and a minority of modacrylic fibers, para-aramid fibers, and antistatic fibers. Garments made from the yarns provide thermal protection such that a wearer would experience less than a 65 percent predicted body burn when exposed to a flash fire exposure of 4 seconds per ASTM F1930, while maintaining a Category 2 arc rating per ASTM F1959 and NFPA 70E.

15 Claims, No Drawings

CRYSTALLIZED META-ARAMID BLENDS FOR IMPROVED FLASH FIRE AND ARC PROTECTION

BACKGROUND OF THE INVENTION

1. Field of the Invention

This invention relates to a blended yarn useful for the production of fabrics that possess not only arc and flame protective properties, but also improved performance when exposed to flash fires. This invention also relates to garments produced with such fabrics.

2. Description of Related Art

When protecting workers from potential flash fires with protective apparel the time of exposure to actual flame is an important consideration. Generally the term "flash" fire is used because the exposure to flame is of very short duration, on the order of seconds. Further, while the difference in a single second seems small, when exposed to fire, an additional second of exposure to a flame can mean a tremendous difference in the burn injury.

The performance of a material in a flash fire can be measured using an instrumented mannequin using the test protocol of ASTM F1930. The mannequin is clothed in the material to be measured, and then exposed to flames from burners; temperature sensors distributed throughout the mannequin measure the local temperature experienced by the mannequin that would be the temperatures experienced by a human body if subjected to the same amount of flames. Given a standard flame intensity, the extent of the burns that would be experienced by a human, (i.e., first degree, second degree, etc.) and the percent of the body burned can be determined from the mannequin temperature data.

U.S. Pat. No. 7,348,059 to Zhu et al. discloses modacrylic/aramid fiber blends for use in arc and flame protective fabrics and garments. Such blends have on average a high content (40-70 weight percent) modacrylic fiber and lower content (10 to 40 weight percent) meta-aramid fiber having a degree of crystallinity of at least 20%, and para-aramid fiber (5 to 20 weight percent). Fabrics and garments made from such blends provide protection from electrical arcs and exposures to flash fires up to 3 seconds. United States Patent Application Publication US2005/0025963 to Zhu discloses an improved fire retardant blend, yarn, fabric and article of clothing made from a blend of 10-75 parts of at least one aramid staple fiber, 15 to 80 parts by weight of at least one modacrylic staple fiber, and 5 to 30 parts by weight of at least one aliphatic polyamide staple fiber. This blend will not provide a Category 2 arc rating for fabrics in the range of 186.5 to 237 grams per square meter (5.5 to 7 ounces per square yard) because of the high proportion of flammable aliphatic polyamide fiber in this blend. U.S. Pat. No. 7,156,883 to Lovasic et al. discloses a fiber blend, fabrics, and protective garments comprising amorphous meta-aramid fiber, crystallized meta-aramid fiber, and flame retardant cellulosic fiber, the meta-aramid fiber being 50 to 85 weight percent with one to two thirds of the meta-aramid fiber being amorphous and with two to one third of the meta-aramid fiber being crystalline. Again, fabrics made by these blends would not provide a Category 2 arc rating for fabrics in the range of 186.5 to 237 grams per square meter (5.5 to 7 ounces per square yard).

The minimum performance required for flash fire protective apparel, per the NFPA 2112 standard, is less than 50% body burn from a 3 second flame exposure. Since flash fire is a very real threat to workers in some industries, and it is not possible to fully anticipate how long the individual will be engulfed in flames, any improvement in the flash fire performance of protective apparel fabrics and garments has the potential to save lives. In particular, if the protective apparel can provide enhanced protection to fire exposure above 3 seconds, e.g. 4 seconds or more, this represents an increase in potential exposure time of as much as 33% or more. Flash fires represent one of the most extreme types of thermal threat a worker can experience; such threats are much more severe than the simple exposure to a flame. Therefore any improvement that provides the combination of improved flash fire performance with a high level of arc protection at a low basis weight is desired.

SUMMARY OF THE INVENTION

This invention relates to yarn for use in arc and flame protection, and fabrics and garments made from that yarn, the yarn consisting essentially of from 50 to 80 weight percent meta-aramid fiber having a degree of crystallinity of at least 20%, 10 to 30 weight percent modacrylic fiber, 5 to 20 weight percent para-aramid fiber, and 1 to 3 weight percent antistatic fiber based on the total weight of components (a), (b), (c) and (d). The fabrics and garments have a basis weight in the range of 186.5 to 237 grams per square meter (5.5 to 7 ounces per square yard).

In one embodiment, garments made from the yarn provide thermal protection such that a wearer would experience less than a 65 percent predicted body burn when exposed to a flash fire exposure of 4 seconds per ASTM F1930, while maintaining a Category 2 arc rating.

DETAILED DESCRIPTION OF THE INVENTION

This invention relates to providing a yarn from which fabrics and garments can be produced that provide both arc protection and superior flash fire protection. Electrical arcs typically involve thousands of volts and thousands of amperes of electrical current, exposing the garment or fabric to intense incident energy. To offer protection to a wearer a garment or fabric must resist the transfer of this energy through to the wearer. It is believed that this occurs by the fabric absorbing a portion of the incident energy and by the fabric resisting break-open, as well as the air-gap between fabric and wearer's body. During break-open a hole forms in the fabric directly exposing the surface or wearer to the incident energy.

In addition to resisting the intense incident energy from an electrical arc, the garments and fabrics also resist the thermal transfer of energy from a long exposure to a flash fire that is greater than 3 seconds. It is believed that this invention reduces energy transfer by absorbing a portion of the incident energy and by improved charring that allows a reduction in transmitted thermal energy.

The yarns consist essentially of a blend of meta-aramid fiber, modacrylic fiber, para-aramid fiber, and antistatic fiber. Typically, yarns consist of 50 to 80 weight percent meta-aramid fiber with a degree of crystallinity of at least 20%, 10 to 30 weight percent modacrylic fiber, 5 to 20 weight percent para-aramid fiber, and 1 to 3 weight percent antistatic fiber. Preferably, yarns consist of 65 to 75 weight percent meta-aramid fiber with a degree of crystallinity of at least 20%, 15 to 25 weight percent modacrylic fiber, 5 to 15 weight percent para-aramid fiber, and 2 to 3 weight percent antistatic fiber. The above percentages are on a basis of the four named components. By "yarn" is meant an assemblage of fibers spun or twisted together to form a continuous strand that can be used in weaving, knitting, braiding, or plaiting, or otherwise made into a textile material or fabric.

As used herein, "aramid" is meant a polyamide wherein at least 85% of the amide (—CONH—) linkages are attached directly to two aromatic rings. Additives can be used with the aramid and, in fact, it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid. Suitable aramid fibers are described in Man-Made Fibers—Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3,354,127; and 3,094,511. Meta-aramid are those aramids where the amide linkages are in the meta-position relative to each other, and para-aramids are those aramids where the amide linkages are in the para-position relative to each other. The aramids most often used are poly(metaphenylene isophthalamide) and poly(paraphenylene terephthalamide).

When used in yarns, the meta-aramid fiber provides a flame resistant char forming fiber with an Limiting Oxygen Index (LOI) of about 26. Meta-aramid fiber is also resistant to the spread of damage to the yarn due to exposure to flame. Because of its balance of modulus and elongation physical properties, meta-aramid fiber also provides for a comfortable fabric useful in single-layer fabric garments meant to be worn as industrial apparel in the form of conventional shirts, pants, and coveralls. It is critical that the yarn has at least 50 weight percent meta-aramid fiber to provide improved char to lightweight fabrics and garments to resist the thermal transfer of energy during extended exposure to flash fires. In some preferred embodiments, the yarn has at least 65 weight percent meta-aramid fibers. In some embodiments, the preferred maximum amount of meta-aramid fibers is 75 weight percent or less; however, amounts as high as 80 weight percent can be used.

By modacrylic fiber it is meant acrylic synthetic fiber made from a polymer comprising primarily acrylonitrile. Preferably the polymer is a copolymer comprising 30 to 70 weight percent of a acrylonitrile and 70 to 30 weight percent of a halogen-containing vinyl monomer. The halogen-containing vinyl monomer is at least one monomer selected, for example, from vinyl chloride, vinylidene chloride, vinyl bromide, vinylidene bromide, etc. Examples of copolymerizable vinyl monomers are acrylic acid, methacrylic acid, salts or esters of such acids, acrylamide, methylacrylamide, vinyl acetate, etc.

The preferred modacrylic fibers are copolymers of acrylonitrile combined with vinylidene chloride, the copolymer having in addition an antimony oxide or antimony oxides for improved fire retardancy. Such useful modacrylic fibers include, but are not limited to, fibers disclosed in U.S. Pat. No. 3,193,602 having 2 weight percent antimony trioxide, fibers disclosed in U.S. Pat. No. 3,748,302 made with various antimony oxides that are present in an amount of at least 2 weight percent and preferably not greater than 8 weight percent, and fibers disclosed in U.S. Pat. Nos. 5,208,105 & 5,506,042 having 8 to 40 weight percent of an antimony compound.

Within the yarns modacrylic fiber provides a flame resistant char forming fiber with an LOI typically at least 28 depending on the level of doping with antimony derivatives. Modacrylic fiber is also resistant to the spread of damage to the yarn due to exposure to flame. Modacrylic fiber while highly flame resistant does not by itself provide adequate tensile strength to a yarn, or fabric made from the yarn, to offer the desired level of break-open resistance when exposed to an electrical arc. The yarn has at least 10 weight percent modacrylic fiber and in some preferred embodiments the yarn has at least 15 weight percent modacrylic fiber. In some embodiments, the preferred maximum amount of modacrylic fiber is 25 weight percent or less; however, amounts as high as 30 weight percent can be used.

Meta-aramid fiber provides additional tensile strength to the yarn and fabrics formed from the yarn. Modacrylic and meta-aramid fiber combinations are highly flame resistant but do not provide adequate tensile strength to a yarn or fabric made from the yarn to offer the desired level of break-open resistance when exposed to an electrical arc.

It is critical that the meta-aramid fiber have a certain minimum degree of crystallinity to realize the improvement in arc protection. The degree of crystallinity of the meta-aramid fiber is at least 20% and more preferably at least 25%. For purposes of illustration due to ease of formation of the final fiber a practical upper limit of crystallinity is 50% (although higher percentages are considered suitable). Generally, the crystallinity will be in a range from 25 to 40%. An example of a commercial meta-aramid fiber having this degree of crystallinity is Nomex® T-450 available from E.I. du Pont de Nemours & Company of Wilmington, Del.

The degree of crystallinity of an meta-aramid fiber is determined by one of two methods. The first method is employed with a non-voided fiber while the second is on a fiber that is not totally free of voids.

The percent crystallinity of meta-aramids in the first method is determined by first generating a linear calibration curve for crystallinity using good, essentially non-voided samples. For such non-voided samples the specific volume (1/density) can be directly related to crystallinity using a two-phase model. The density of the sample is measured in a density gradient column. A meta-aramid film, determined to be non-crystalline by x-ray scattering methods, was measured and found to have an average density of 1.3356 g/cm3. The density of a completely crystalline meta-aramid sample was then determined from the dimensions of the x-ray unit cell to be 1.4699 g/cm3. Once these 0% and 100% crystallinity end points are established, the crystallinity of any non-voided experimental sample for which the density is known can be determined from this linear relationship:

$$\text{Crystallinity} = \frac{(1/\text{non-crystalline density}) - (1/\text{experimental density})}{(1/\text{non-crystalline density}) - (1/\text{fully-crystalline density})}$$

Since many fiber samples are not totally free of voids, Raman spectroscopy is the preferred method to determine crystallinity. Since the Raman measurement is not sensitive to void content, the relative intensity of the carbonyl stretch at 1650-1 cm can be used to determine the crystallinity of a meta-aramid in any form, whether voided or not. To accomplish this, a linear relationship between crystallinity and the intensity of the carbonyl stretch at 1650 cm-1, normalized to the intensity of the ring stretching mode at 1002 cm-1, was developed using minimally voided samples whose crystallinity was previously determined and known from density measurements as described above. The following empirical relationship, which is dependent on the density calibration curve, was developed for percent crystallinity using a Nicolet Model 910 FT-Raman Spectrometer:

$$\%\ \text{crystallinity} = 100.0 \times \frac{(I(1650\ \text{cm-1}) - 0.2601)}{0.1247}$$

where I(1650 cm-1) is the Raman intensity of the meta-aramid sample at that point. Using this intensity the percent crystallinity of the experiment sample is calculated from the equation.

Meta-aramid fibers, when spun from solution, quenched, and dried using temperatures below the glass transition temperature, without additional heat or chemical treatment, develop only minor levels of crystallinity. Such fibers have a percent crystallinity of less than 15 percent when the crystallinity of the fiber is measured using Raman scattering techniques. These fibers with a low degree of crystallinity are considered amorphous meta-aramid fibers that can be crystallized through the use of heat or chemical means. The level of crystallinity can be increased by heat treatment at or above the glass transition temperature of the polymer. Such heat is typically applied by contacting the fiber with heated rolls under tension for a time sufficient to impart the desired amount of crystallinity to the fiber.

The level of crystallinity of m-aramid fibers can be increased by a chemical treatment, and in some embodiments this includes methods that color, dye, or mock dye the fibers prior to being incorporated into a fabric. Some methods are disclosed in, for example, U.S. Pat. Nos. 4,668,234; 4,755,335; 4,883,496; and 5,096,459. A dye assist agent, also known as a dye carrier may be used to help increase dye pick up of the aramid fibers. Useful dye carriers include aryl ether, benzyl alcohol, or acetophenone.

Para-aramid fibers provide a high tensile strength fiber that when added in adequate amounts in the yarn improves the break-open resistance of fabrics formed from the yarn after flame exposure. Large amounts of para-aramid fibers in the yarns make garments comprising the yarns uncomfortable to the wearer. The yarn has at least 5 weight percent para-aramid fibers. In some embodiments, the preferred maximum amount of para-aramid fibers is 15 weight percent or less; however, amounts as high as 20 weight percent can be used.

The term tensile strength refers to the maximum amount of stress that can be applied to a material before rupture or failure. The tear strength is the amount of force required to tear a fabric. In general the tensile strength of a fabric relates to how easily the fabric will tear or rip. The tensile strength can also relate to the ability of the fabric to avoid becoming permanently stretched or deformed. The tensile and tear strengths of a fabric should be high enough so as to prevent ripping, tearing, or permanent deformation of the garment in a manner that would significantly compromise the intended level of protection of the garment.

Because static electrical discharges can be hazardous for workers working with sensitive electrical equipment or near flammable vapors, the yarn, fabric, or garment contains an antistatic component. Illustrative examples are steel fiber, carbon fiber, or a carbon combined with an existing fiber. The antistatic component is present in an amount of 1 to 3 weight percent of the total yarn. In some preferred embodiments the antistatic component is present in an amount of only 2 to 3 weight percent. U.S. Pat. No. 4,612,150 (to De Howitt) and U.S. Pat. No. 3,803,453 (to Hull) describe an especially useful conductive fiber wherein carbon black is dispersed within a thermoplastic fiber, providing anti-static conductance to the fiber. The preferred antistatic fiber is a carbon-core nylon-sheath fiber. Use of anti-static fibers provides yarns, fabrics, and garments having reduced static propensity, and therefore, reduced apparent electrical field strength and nuisance static.

Yarns can be produced by yarn spinning techniques such as but not limited to ring spinning, core spinning, and air jet spinning, including air spinning techniques such as Murata air jet spinning where air is used to twist staple fibers into a yarn, provided the required degree of crystallinity is present in the final yarn. If single yarns are produced, they are then preferably plied together to form a ply-twisted yarn comprising at least two single yarns prior to being converted into a fabric.

To provide protection from the intense thermal stresses caused by electrical arcs it is desirable that an arc protective fabric and garments formed from that fabric possess features such as an LOI above the concentration of oxygen in air (that is, greater than 21 and preferably greater than 25) for flame resistance, a short char length indicative of slow propagation of damage to the fabric, and good break-open resistance to prevent incident energy from directly impinging on the surfaces below the protective layer.

The term fabric, as used in the specification and appended claims, refers to a desired protective layer that has been woven, knitted, or otherwise assembled using one or more different types of the yarn previously described. A preferred embodiment is a woven fabric, and a preferred weave is a twill weave. In some preferred embodiments the fabrics have an arc resistance, normalized for basis weight, of at least 1.1 calories per square centimeter per ounce per square yard (0.14 Joules per square centimeter per grams per square meter). In some embodiments the arc resistance normalized for basis weight is preferably at least 1.3 calories per square centimeter per ounce per square yard (0.16 Joules per square centimeter per grams per square meter).

Yarns having the proportions of meta-aramid fiber, modacrylic fiber, para-aramid fiber and antistatic fiber as previously described, are exclusively present in the fabric. In the case of a woven fabric the yarns are used in both the warp and fill of the fabric. If desired, the relative amounts of meta-aramid fiber, modacrylic fiber, para-aramid fiber and antistatic fiber can vary in the yarns as long as the composition of the yarns falls within the previously described ranges.

The yarns used in the making of fabrics consist essentially of the meta-aramid fiber, modacrylic fiber, para-aramid fiber and antistatic fiber as previously described, in the proportions described, and do not include any other additional thermoplastic or combustible fibers or materials. Other materials and fibers, such as polyamide or polyester fibers, provide combustible material to the yarns, fabrics, and garments, and are believed to affect the flash fire performance of the garments.

Garments made from yarns having the proportions of meta-aramid fiber, modacrylic fiber, para-aramid fiber, and antistatic fiber as previously described provide thermal protection to the wearer that is equivalent to less than a 65 percent predicted body burn when exposed to a flash fire of 4 seconds while maintaining a Category 2 arc rating. This is a significant improvement over the minimum standard of less than a 50 percent predicted body burn to the wearer at a 3 second exposure; burn injury is essentially exponential in nature with respect to flame exposure for some other flame resistance fabrics. The protection provided by the garment, should there be an additional second of flame exposure time, can potentially mean the difference between life and death.

There are two common category rating systems for arc ratings. The National Fire Protection Association (NFPA) has 4 different categories with Category 1 having the lowest performance and Category 4 having the highest performance.

Under the NFPA 70E system, Categories 1, 2, 3, and 4 correspond to a heat flux through the fabric of 4, 8, 25, and 40 calories per square centimeter, respectively. The National Electric Safety Code (NESC) also has a rating system with 3 different categories with Category 1 having the lowest performance and Category 3 having the highest performance. Under the NESC system, Categories 1, 2, and 3 correspond to a heat flux through the fabric of 4, 8, and 12 calories per square centimeter, respectively. Therefore, a fabric or garment having a Category 2 arc rating can withstand a thermal flux of 8 calories per square centimeter, as measured per standard set method ASTM F1959.

The performance of the garments in a flash fire is measured using an instrumented mannequin using the test protocol of ASTM F1930. The mannequin is clothed in the garment and exposed to flames from burners and sensors measure the localized skin temperatures that would be experienced by a human body if subjected to the same amount of flames. Given a standard flame intensity, the extent of the burns that would be experienced by a human, (i.e., first degree, second degree, etc.) and the percent of the body burned can be determined from the mannequin temperature data. A low predicted body burn is an indication of better protection of the garment in flash fire hazard.

It is believed the use of crystalline meta-aramid fiber in the yarns, fabrics, and garments as previously described not only can provide improved performance in flash fires, but also results in significantly reduced laundry shrinkage. This reduced shrinkage is based on an identical fabric wherein the only difference is the use of meta-aramid fiber having the degree of crystallinity set forth previously compared to an meta-aramid fiber that has not been treated to increase crystallinity. For purposes herein shrinkage is measured after a wash cycle of 20 minutes with a water temperature of 140° F. Preferred fabrics demonstrate a shrinkage of 5 percent or less after 10 wash cycles and preferably after 20 cycles. As the amount of fabric per unit area increases, the amount of material between a potential hazard and the subject to be protected increases. An increase in fabric basis weight results in increased break-open resistance, increased thermal protection factor, and increased arc protection; however it is not evident how improved performance can be achieved with lighter weight fabrics. The yarns as previously described allow the use of lighter weight fabrics in protective apparel, particularly in more comfortable single fabric garments, with improved performance. The basis weight of fabrics that have both the desired arc and flash fire performance is 186.5 g/m$^2$ (5.5 oz/yd) or greater, preferably 200 g/m$^2$ (6.0 oz/yd$^2$) or greater. In some embodiments, the preferred maximum basis weight is 237 g/m$^2$ (7.0 oz/yd$^2$). Above this maximum the comfort benefits of the lighter weight fabric in single fabric garments is believed to be reduced, because it is believed higher basis weight fabric would show increased stiffness.

Char length is a measure of the flame resistance of a textile. A char is defined as a carbonaceous residue formed as the result of pyrolysis or incomplete combustion. The char length of a fabric under the conditions of test of ASTM 6413-99 as reported in this specification is defined as the distance from the fabric edge that is directly exposed to the flame to the furthest point of visible fabric damage after a specified tearing force has been applied. Per NFPA 2112 standard the fabric shall have a char length of less than 4 inches.

In some preferred embodiments, the fabric is used as a single layer in a protective garment. Within this specification the protective value of a fabric is reported for a single layer of that fabric. In some embodiments this invention also includes a multi-layer garment made from the fabric.

In some particularly useful embodiments, spun staple yarns having the proportions of meta-aramid fiber, modacrylic fiber, para-aramid fiber and antistatic fiber as previously described, can be used to make flame-resistant garments. In some embodiments the garments can have essentially one layer of the protective fabric made from the spun staple yarn. Exemplary garments of this type include jumpsuits and coveralls for fire fighters or for military personnel. Such suits are typically used over the firefighters clothing and can be used to parachute into an area to fight a forest fire. Other garments can include pants, shirts, gloves, sleeves and the like that can be worn in situations such as chemical processing industries or industrial electrical/utility where an extreme thermal event might occur.

TEST METHODS

The abrasion performance of fabrics is determined in accordance with ASTM D-3884-01 "Standard Guide for Abrasion Resistance of Textile Fabrics (Rotary Platform, Double Head Method)".

The arc resistance of fabrics is determined in accordance with ASTM F-1959-99 "Standard Test Method for Determining the Arc Thermal Performance Value of Materials for Clothing".

The break strength of fabrics is determined in accordance with ASTM D-5034-95 "Standard Test Method for Breaking Strength and Elongation of Fabrics (Grab Test)".

The limited oxygen index (LOI) of fabrics is determined in accordance with ASTM G-125-00 "Standard Test Method for Measuring Liquid and Solid Material Fire Limits in Gaseous Oxidants".

The tear resistance of fabrics is determined in accordance with ASTM D-5587-03 "Standard Test Method for Tearing of Fabrics by Trapezoid Procedure".

The thermal protection performance of fabrics is determined in accordance with NFPA 2112 "Standard on Flame Resistant Garments for Protection of Industrial Personnel Against Flash Fire". The term thermal protective performance (or TPP) relates to a fabric's ability to provide continuous and reliable protection to a wearer's skin beneath a fabric when the fabric is exposed to a direct flame or radiant heat.

Flash fire protection level testing was done according to ASTM F-1930 using an instrumented thermal mannequin with standard pattern coverall made with the test fabric.

The char length of fabrics is determined in accordance with ASTM D-6413-99 "Standard Test Method for Flame Resistance of Textiles (Vertical Method)".

The minimum concentration of oxygen, expressed as a volume percent, in a mixture of oxygen and nitrogen that will just support flaming combustion of a fabrics initially at room temperature is determined under the conditions of ASTM G125/D2863.

Shrinkage is determined by physically measuring unit area of a fabric after one or more wash cycles. A cycle denotes washing the fabric in an industrial washing machine for 20 minutes with a water temperature of 140 degrees F.

To illustrate the present invention, the following examples are provided. All parts and percentages are by weight and degrees in Celsius unless otherwise indicated.

EXAMPLES

Example 1

This example illustrates a yarn, fabric, and garment having a majority of meta-aramid fiber having a degree of crystallinity that is at least 20%, combined with a minority of modacrylic fiber, para-aramid fiber, and antistatic fiber. This material has both the desired arc rating of 2 and a instrumented thermal mannequin predicted body burn at 4 seconds exposure of <65%.

A durable arc and thermal protective fabric is prepared having in the both warp and fill airjet spun yarns of intimate blends of Nomex® type 450 fiber, Kevlar® 29 fiber, modacrylic fiber, and antistatic fiber. Nomex® type 450 is poly(m-phenylene isophthalamide)(MPD-I) having a degree of crystallinity of 33-37%. The modacrylic fiber is ACN/polyvinylidene chloride co-polymer fiber having 6.8% antimony (known commercially as Protex®C). The Kevlar® 29 fiber is poly(p-phenylene terephthalamide) (PPD-T) fiber and the antistatic fiber is a carbon-core nylon-sheath fiber known commercially as P140.

A picker blend sliver of 70 weight percent of Nomex® type 450 fiber, 8 weight percent of Kevlar® 29 fiber, 20 weight percent of modacrylic fiber and 2 weight percent P140 fiber is prepared and is made into spun staple yarn using cotton system processing and an airjet spinning frame. The resultant yarn is a 21 tex (28 cotton count) single yarn. Two single yarns are then plied on a plying machine to make a two-ply yarn having 10 turns/inch twist.

The yarn is then used as in the warp and fill of a fabric that is made on a shuttle loom in a 3×1 twill construction. The greige twill fabric has a basis weight of 203 g/m$^2$ (6 oz/yd$^2$). The greige twill fabric is then scoured in hot water and is jet dyed using basic dye and dried. The finished twill fabric has a construction of 31 ends×16 picks per cm (77 ends×47 picks per inch) and a basis weight of 220 g/m$^2$ (6.5 oz/yd$^2$). A portion of this fabric is then tested for its arc, thermal and mechanical properties, and a portion is converted into single-layer protective coveralls for flash fire testing.

Example 2

This is another example illustrating a yarn, fabric, and garment having a majority of meta-aramid fiber having a degree of crystallinity that is at least 20%, combined with a minority of modacrylic fiber, para-aramid fiber, and antistatic fiber. This material has both the desired arc rating of 2 and a instrumented thermal mannequin predicted body burn at 4 seconds exposure of <65%.

Example 1 is repeated, except an identical amount of Nomex® type N301 fiber is substituted in the intimate blend for the Nomex® type 450 fiber. Nomex® type N301 fiber is a blend of 95% of poly(m-phenylene isophthalamide)(MPD-I) fiber that has been producer colored and having a degree of crystallinity of from about 33 to 37%, and 5% Kevlar® 29 fiber. This results in a final sliver having a blend of 66.5 weight percent crystallized meta-aramid fiber, 20 weight percent modacrylic fiber, 11.5 weight percent para-aramid fiber, and 2 percent antistatic fiber.

A portion of this fabric is then tested for its arc, thermal and mechanical properties, and a portion is converted into single-layer protective coveralls for flash fire testing.

Comparison Example A

This example illustrates a comparative yarn, fabric, and garment having meta-aramid fiber having a degree of crystallinity that is less than 20%. This material has an undesirable arc rating of less than 2.

A durable arc and thermal protective fabric is prepared as in Example 1, however an identical amount of uncrystallized Nomex® type 455 is substituted in the intimate blend for of Nomex® type 450 fiber.

A portion of this fabric is then tested for its arc, thermal and mechanical properties, and a portion is converted into single-layer protective coveralls for flash fire testing.

Comparison Example B

This example illustrates a comparative yarn, fabric, and garment having meta-aramid fiber having a degree of crystallinity that is at least 20%, combined with flame-retardant rayon fiber, para-aramid fiber, and antistatic fiber. This material has an undesirable arc rating of less than 2.

A durable arc and thermal protective fabric is prepared as in Example A, however an identical amount of Nomex® type 450 is substituted in the intimate blend for the uncrystallized Nomex® type 455 fiber and an identical amount of FR rayon fiber is substituted for the modacrylic fiber in the yarns. Nomex® type 450 is poly(m-phenylene isophthalamide) (MPD-I) having a degree of crystallinity of 33-37%.

A portion of this fabric is then tested for its arc, thermal and mechanical properties, and a portion is converted into single-layer protective coveralls for flash fire testing.

Comparison Example C

This example illustrates a comparative yarn, fabric, and garment having a majority of modacrylic fiber and a minority of meta-aramid fiber having a degree of crystallinity that is at least 20% combined with para-aramid fiber, and antistatic fiber. While this material has an acceptable arc rating of 2, the instrumented thermal mannequin predicted body burn at 4 seconds exposure is an undesirable >70%.

A durable arc and thermal protective fabric is prepared as in Example A, however Nomex® type 450 is substituted in the intimate blend for of Nomex® type 455 fiber and the amount of the Nomex® 450 in the blend is reduced to 25 weight percent, while the amount of modacrylic fiber in the intimate blend is raised to 65 weight percent. The amounts of para-aramid and antistatic fiber remains the same. Nomex® type 450 is poly(m-phenylene isophthalamide)(MPD-I) having a degree of crystallinity of 33-37%.

A portion of this fabric is then tested for its arc, thermal and mechanical properties, and a portion is converted into single-layer protective coveralls for flash fire testing.

The Table summarizes the expected performance of the yarns, fabrics, and garments described in the examples. The comparative materials either do not have adequate arc ratings or do not have the desirable performance in flash fire testing.

TABLE

| | Example 1 | Example 2 | Example A | Example B | Example C |
|---|---|---|---|---|---|
| Nominal Basis Weight (opsy) | 6.5 | 6.5 | 6.5 | 6.5 | 6.5 |
| ARC rating (category) | 2 | 2 | 1 | 1 | 2 |
| Instrumented Thermal Mannequin Predicted Body Burn(%) at 4 sec. | <65 | <65 | <65 | <65 | >70 |
| Grab Test Break Strength (lbf) W/F | +1 | +1 | +1 | 0 | −1 |
| Trap Tear (lbf) W/F | +1 | +1 | +1 | 0 | −1 |
| Taber Abrasion (Cycles)CS- | +1 | +1 | +1 | 0 | −1 |

TABLE-continued

| | Example 1 | Example 2 | Example A | Example B | Example C |
|---|---|---|---|---|---|
| 10/1000 g TPP (cal/cm2) | 0 | 0 | 0 | 0 | 0 |
| Vertical Flame (in) W/F | 0 | 0 | 0 | +1 | −1 |

What is claimed is:

1. A yarn for use in arc and flame protection consisting essentially of:

(a) 50 to 80 weight percent meta-aramid fiber having a degree of crystallinity of at least 20%;

(b) 10 to 30 weight percent modacrylic fiber;

(c) 5 to 20 weight percent para-aramid fiber; and (d) 1 to 3 weight percent antistatic fiber;

said percentages on the basis of components (a), (b), (c), and (d).

2. The yarn of claim 1 consisting essentially of:

(a) 65 to 75 weight percent meta-aramid fiber;

(b) 15 to 25 weight percent modacrylic fiber;

(c) 5 to 15 weight percent para-aramid fiber; and (d) 2 to 3 weight percent antistatic fiber.

3. The yarn of claim 1 wherein the anti-static component comprises carbon or metal.

4. The yarn of claim 1 with the meta-aramid fiber has a degree of crystallinity in a range from 20 to 50%.

5. A fabric suitable for use in arc and flame protection comprising a yarn consisting essentially of:

(a) 50 to 80 weight percent meta-aramid fiber having a degree of crystallinity of at least 20%;

(b) 10 to 30 weight percent modacrylic fiber;

(c) 5 to 20 weight percent para-aramid fiber; and (d) 1 to 3 weight percent antistatic fiber;

said percentages on the basis of components (a), (b), (c), and (d);

the fabric having a basis weight in the range of 186.5 to 237 grams per square meter (5.5 to 7 ounces per square yard).

6. The fabric of claim 5 wherein the yarn consists essentially of:

(a) 65 to 75 weight percent meta-aramid fiber;

(b) 15 to 25 weight percent modacrylic fiber;

(c) 5 to 15 weight percent para-aramid fiber; and (d) 2 to 3 weight percent antistatic fiber.

7. The fabric of claim 5 having a char length according to ASTM D-6413-99 of less than 6 inches.

8. The fabric of claim 5 having arc resistance according to ASTM F-1959-99 of at least 1.1 calories per square centimeter per ounce per square yard of fabric.

9. The fabric of claim 8 wherein the arc resistance is at least 1.3 calories per square centimeter per ounce per square yard of fabric.

10. The fabric of claim 5 wherein the meta-aramid fiber has a degree of crystallinity in a range from 20 to 50%.

11. The fabric of claim 5 having a shrinkage of 5% or less after 10 wash cycles.

12. A garment suitable for use in arc and flame protection comprising a fabric consisting essentially of:

(a) 50 to 80 weight percent meta-aramid fiber having a degree of crystallinity of at least 20%;

(b) 10 to 30 weight percent modacrylic fiber;

(c) 5 to 20 weight percent para-aramid fiber; and (d) 1 to 3 weight percent antistatic fiber;

said percentages on the basis of components (a), (b), (c), and (d)

the fabrics having a basis weight in the range of 186.5 to 237 grams per square meter (5.5 to 7 ounces per square yard).

13. The garment of claim 12 wherein the fabric consists essentially of:

(a) 65 to 75 weight percent meta-aramid fiber;

(b) 15 to 25 weight percent modacrylic fiber;

(c) 5 to 15 weight percent para-aramid fiber; and (d) 2 to 3 weight percent antistatic fiber.

14. The garment of claim 12, providing thermal protection equivalent to less than a 65% body burn at a 4 sec flame exposure per ASTM F1930, while maintaining a Category 2 arc rating per ASTM F1959 and NFPA 70E.

15. The garment of claim 12 wherein the fabric has a shrinkage of 5% or less after 10 wash cycles.

* * * * *